US009546529B2

(12) United States Patent
Garcia

(10) Patent No.: US 9,546,529 B2
(45) Date of Patent: Jan. 17, 2017

(54) PRESSURE ACTUATION ENABLING METHOD

(75) Inventor: Luis A. Garcia, Kingwood, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 481 days.

(21) Appl. No.: 13/363,901

(22) Filed: Feb. 1, 2012

(65) Prior Publication Data

US 2013/0192827 A1 Aug. 1, 2013

(51) Int. Cl.
*E21B 23/06* (2006.01)

(52) U.S. Cl.
CPC ..... *E21B 23/06* (2013.01)

(58) Field of Classification Search
CPC .... E21B 33/129; E21B 34/103; E21B 34/063; E21B 23/06
USPC ..... 166/296, 376, 386
See application file for complete search history.

(56) References Cited

U.S. PATENT DOCUMENTS

| | | | | |
|---|---|---|---|---|
| 5,479,986 | A | 1/1996 | Gano et al. | |
| 5,947,204 | A | 9/1999 | Barton | |
| 7,775,283 | B2 | 8/2010 | Coronado et al. | |
| 2004/0020832 | A1 * | 2/2004 | Richards et al. | 210/106 |
| 2007/0215352 | A1 | 9/2007 | Shaw et al. | |
| 2011/0048743 | A1 | 3/2011 | Stafford et al. | |

FOREIGN PATENT DOCUMENTS

EP 0427422 A2 5/1991

OTHER PUBLICATIONS

Notification of Transmittal of the International Search Report and the Written Opinion of the International Searching Authority; PCT/US2012/071741; Mailed Apr. 8, 2013; Korean Intelllectual Property Office; 10 pages.

* cited by examiner

*Primary Examiner* — David Bagnell
*Assistant Examiner* — Kristyn Hall
(74) *Attorney, Agent, or Firm* — Cantor Colburn LLP

(57) ABSTRACT

A pressure actuation enabling method includes plugging a passage that fluidically connects an inside with an outside of a tubular with a plug, building differential pressure across the plug, actuating an actuator with the differential pressure and removing the plug.

6 Claims, 2 Drawing Sheets

PRESSURE ACTUATION ENABLING METHOD

BACKGROUND

It is common in tubular systems to actuate an actuator using pressure. Doing so often requires plugging a passageway so that pressure can be built thereagainst. In cases wherein it is desirable to flow through the passageway after having built pressure against a plug engaged therewith the plug must be removed. Methods such as drilling or milling to remove a runnable plug work well for some applications. However, the time to run the drilling/milling equipment and perform the machining operation can be costly in lost production in the case where the tubular system is employed to recover hydrocarbons from an earth formation, for example. The art is therefore always interested in methods of allowing actuation without the aforementioned drawback.

BRIEF DESCRIPTION

Disclosed herein is a pressure actuation enabling method which includes plugging a passage that fluidically connects an inside with an outside of a tubular with a plug, building differential pressure across the plug, actuating an actuator with the differential pressure and removing the plug.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
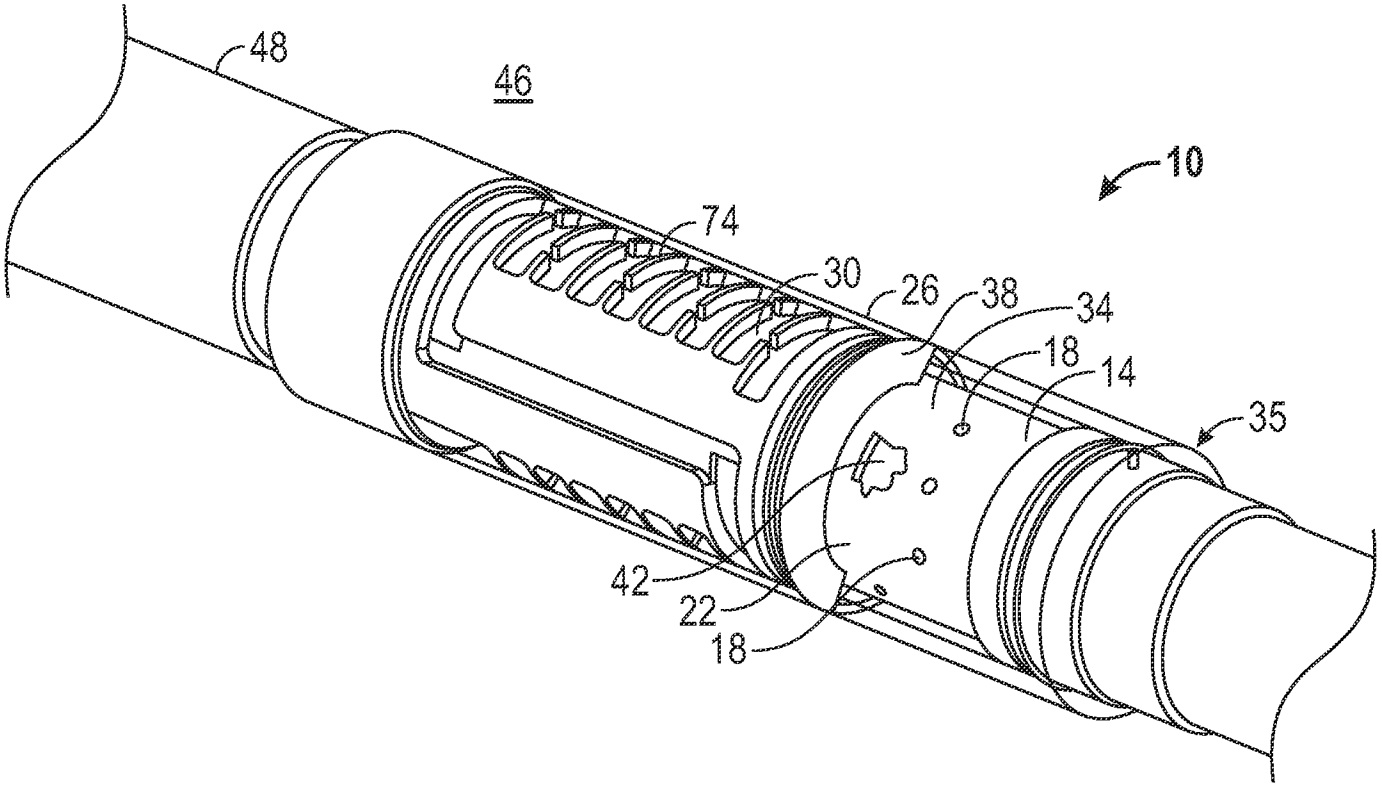
FIG. 1 depicts a partially transparent perspective view of a tubular arrangement configured to enable pressure actuation of an actuator.

Referring to FIG. 1 a tubular arrangement configured to enable pressure actuation of an actuator is illustrated at 10. The tubular arrangement 10 includes a base pipe 14 with perforations 18 through a wall 22 thereof and a sleeve 26 positioned radially of the base pipe 14 defining a passageway 30 in the annular space 34 therebetween. Fluidic communication is established between an inside 42 and an outside 46 through at least the annular space 34 and the perforations 18. Additional flow channels, such as a screen 48 and an equalizer 74, as shown in this embodiment, may also be included in the passageway 30. The sleeve 26 is sealingly attached to the base pipe 14 at an end 35. A plug 38 occludes the passageway 30 thereby preventing fluidic communication between the inside 42 and the outside 46 of the tubular arrangement 10. The plug 38 is configured to support differential pressure between the inside 42 and the outside 46. The differential pressure may be sufficient to actuate an actuator (item 58 of FIG. 2). For example, the differential pressure could inflate a bladder of an inflatable packer or move a piston 62 (FIG. 2), such as the packer and the piston disclosed in U.S. Pat. No. 7,621,322 to Arnold et al. incorporated by reference herein in its entirety.

The plug 38 is also configured to dissolve after being exposed to an environment, after which fluid communication between the inside 42 and the outside 46 is established via the passageway 30. Such fluid communication prevents further building pressure differential between the inside 42 and the outside 46. The plug 38 may be made of a high strength controlled electrolytic metallic material that is degradable/dissolvable in environments that include one or more of brine, acid, and aqueous fluid. For example, a variety of suitable materials and their methods of manufacture are described in United States Patent Publication No. 2011/0135953 (Xu et al.), which is hereby incorporated by reference in its entirety. Exposing the plug 38 to the degradable environment can be controlled in different ways. For example, fluid containing the aforementioned brine, acid or aqueous fluid can be introduced via pumping through the base pipe 14 and the perforations 18 to the plug 38.

Figure 2:
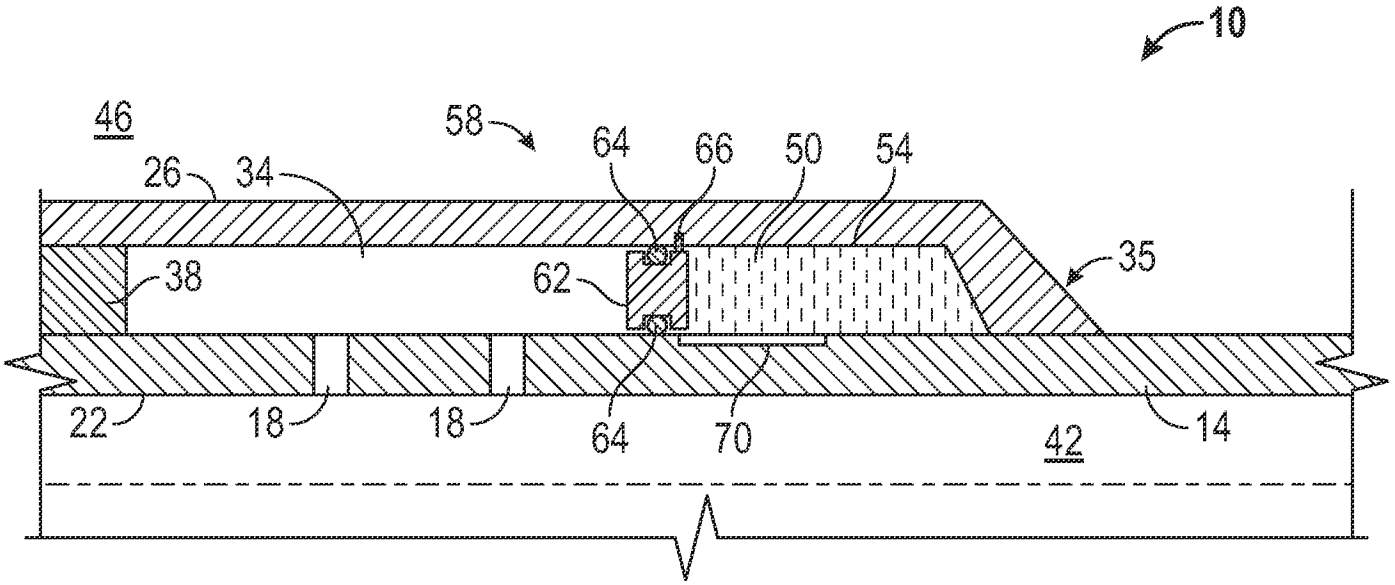
FIG. 2 depicts a partial cross sectional side view of an embodiment of a tubular arrangement disclosed herein.

Referring to FIG. 2, alternately, the brine, acid or aqueous fluid 50 can be stored near the plug 38 in a chamber 54, for example, and then allowed to access the plug 38 after actuation of an actuator 58. The actuator 58 illustrated in this embodiment includes the piston 62 sealably engaged with both the tubulars 14 and 26 by seals 64 thereby defining the chamber 54. A releasable member 66, illustrated herein as a shear screw, fixes the piston 62 relative to the tubulars 14, 26 until pressure acting on the piston 62 is sufficient to release the releasable member 66. Air or other compressible fluid stored in the chamber 54 with the brine, acid or aqueous fluid 50 prior to release of the releasable member 66 can facilitate generating longitudinal force on the piston 62 in response to differential pressure across the piston 62. Upon release of the releasable member 66, the piston 62 moves toward the chamber 54 (rightward in the Figure) until the seal 64 crosses a channel 70 in the base pipe 14 (note the channel 70 could just as well be formed in the sleeve 26) thereby allowing the fluid 50 to flow through the channel 70 by the seal 64 and out of the chamber 54. Once the brine, acid or aqueous fluid 50 is out of the chamber 54 it can make contact with the plug 38, thereby initiating dissolution thereof. The foregoing results in delay of initiation of dissolution of the plug 38 until after the actuation of the actuator 58 has taken place. It should be noted that additional actuation of actuators other than the actuator 58 can also be performed via differential pressure built against the plug 38. By causing other such actuations at pressures lower than that needed to release the releasable member 66, any practical number of actuations are possible prior to removal of the plug 38.

In yet another alternate embodiment, the plug 38 can be exposed to a degradable environment that occurs in response to positioning of the tubular arrangement 10 within a given environment. For example, in a downhole hydrocarbon recover or carbon dioxide sequestration application, exposure of the plug 38 can be initiated by simply positioning the tubular arrangement 10 downhole within an anticipated environment. In such an embodiment, degradation of the plug 38 can begin upon initial exposure to fluid, temperatures and pressures, for example, of the downhole environment that reach the plug 38 after flowing from the outside 46 through the screen 48 the equalizer 74 and the annular space 34 to reach the plug 38. In this embodiment the plug 38 can be configured so that a selected amount of time passes after exposure to the degrading environment has begun to allow the differential pressure to form and the actuation to take place before the plug 38 degrades enough to prevent maintaining the differential pressure. The equalizer 74, shown positioned within the annular space 34, can permit additional control of fluid flow between the outside 46 and the inside 42 after the plug 38 has been removed.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed:

1. A pressure actuation enabling method comprising:

plugging an annular passage defined radially between a first tubular positioned radially of a second tubular that fluidically connects an inside of the first tubular with an outside of the second tubular with a plug positioned within the annular passage;

building differential pressure within the annular passage across the plug;

actuating an actuator with the differential pressure, the actuating exposing the plug to an environment dissolvable thereof; and removing the plug.

2. The pressure actuation enabling method of claim 1, wherein the building differential pressure is via increasing pressure within the first tubular.

3. The pressure actuation enabling method of claim 1, wherein the removing of the plug includes pumping fluid through the first tubular to initiate dissolving of the plug.

4. The pressure actuation enabling method of claim 1, wherein the actuating includes moving a member.

5. The pressure actuation enabling method of claim 1, further comprising exposing the plug to one or more of a brine, an acid and an aqueous fluid to initiate removing the plug.

6. The pressure actuation enabling method of claim 1, further comprising delaying initiation of removing of the plug until an actuation has taken place.

* * * * *